US008157059B2

(12) United States Patent
Takeuchi et al.

(10) Patent No.: US 8,157,059 B2
(45) Date of Patent: Apr. 17, 2012

(54) DESTINATION FLOOR INDICATION DEVICE OF ELEVATOR

(75) Inventors: Nobukazu Takeuchi, Chiyoda-ku (JP); Kazuya Izuta, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 443 days.

(21) Appl. No.: 12/522,310

(22) PCT Filed: Feb. 26, 2007

(86) PCT No.: PCT/JP2007/053511

§ 371 (c)(1),
(2), (4) Date: Jul. 7, 2009

(87) PCT Pub. No.: WO2008/105050

PCT Pub. Date: Sep. 4, 2008

(65) Prior Publication Data

US 2010/0044162 A1 Feb. 25, 2010

(51) Int. Cl.
*B66B 1/34* (2006.01)

(52) U.S. Cl. ..... 187/396; 187/391

(58) Field of Classification Search ..... 187/247, 187/391–396

See application file for complete search history.

(56) References Cited

U.S. PATENT DOCUMENTS

| | | | | |
|---|---|---|---|---|
| 5,679,934 | A * | 10/1997 | Juntunen et al. | 187/395 |
| 6,502,668 | B1 * | 1/2003 | Chida et al. | 187/395 |
| 6,550,587 | B1 * | 4/2003 | Yuasa et al. | 187/394 |
| 6,997,288 | B2 * | 2/2006 | Kakko et al. | 187/391 |
| 7,040,458 | B2 * | 5/2006 | Forsythe et al. | 187/396 |
| 7,040,459 | B2 | 5/2006 | Matsuda et al. | |
| 7,281,610 | B2 * | 10/2007 | Ylinen et al. | 187/382 |
| 7,322,446 | B2 * | 1/2008 | Terry et al. | 187/391 |
| 7,469,772 | B2 * | 12/2008 | Takeuchi | 187/396 |
| 7,591,348 | B2 * | 9/2009 | Takeuchi | 187/391 |
| 7,610,995 | B2 * | 11/2009 | Ylinen et al. | 187/382 |
| 8,069,957 | B2 * | 12/2011 | Miyajima et al. | 187/391 |
| 2010/0243381 | A1 * | 9/2010 | Hoshino et al. | 187/391 |

FOREIGN PATENT DOCUMENTS

| | | |
|---|---|---|
| CN | 1302977 | 3/2007 |
| JP | 6 15394 | 3/1994 |
| JP | 8-59108 | 3/1996 |

(Continued)

OTHER PUBLICATIONS

Office Action issued Dec. 28, 2010, in Korean Patent Application No. 10-2009-7012685.

(Continued)

*Primary Examiner* — Anthony Salata
(74) *Attorney, Agent, or Firm* — Oblon, Spivak, McClelland, Maier & Neustadt, L.L.P.

(57) ABSTRACT

A destination floor indication device that enables elevator users to get to know destination floors that have already been registered easily and in a short time. For this purpose, a destination floor indication device installed in a hall or car of the elevator is includes an indication part that indicates registered destination floors to elevator users, and indication contents of this indication part are controlled by an indication control part. It is ensured through the control by the indication control part that when the number of indications of registered destination floors exceeds a prescribed specified value, the size of indications of destination floors is made smaller than when the specified value is not exceeded, whereby all registered destination floors are caused to be indicated in the indication part.

6 Claims, 4 Drawing Sheets

FOREIGN PATENT DOCUMENTS

| | | |
|---|---|---|
| JP | 2510746 | 6/1996 |
| JP | 8-183222 | 7/1996 |
| JP | 9 227041 | 9/1997 |
| JP | 2001-287876 | 10/2001 |
| JP | 2002-095848 | 4/2002 |
| JP | 2002 142002 | 5/2002 |
| JP | 2003 15637 | 1/2003 |
| WO | 03 086934 | 10/2003 |
| WO | WO2005/105643 | 11/2005 |

OTHER PUBLICATIONS

Japanese Notification of Reason(s) for Refusal in Japanese Patent Application No. 2009-501051, issued Jan. 24, 2012, with English translation.

* cited by examiner

DESTINATION FLOOR INDICATION DEVICE OF ELEVATOR

TECHNICAL FIELD

The present invention relates to a destination floor indication device that is installed in a hall or car of an elevator and indicates destination floors of the elevator to users in the hall or car.

BACKGROUND ART

An elevator hall and a car that carries elevator users and ascends and descends in a shaft are provided with a destination floor indication device that indicates destination floors to the users in the hall or car.

As a related art of such a destination floor indication device, there have been disclosed destination floor indication devices that indicate destination floors to the users in the car by lighting a car call button itself for registering destination floors or a light that corresponds to this car call button (refer to Patent Document 1, for example).

Also, as an another related art, there have been disclosed destination floor indication devices that are provided with an indicator for indicating destination floors and function in such a manner that when the number of letters indicated on the indicator is smaller than a prescribed number of letters, all letters necessary for indications are simultaneously indicated and a changeover to scroll indication is made when the number of letters indicated on the indicator exceeds the prescribed number of letters (refer to Patent Document 2, for example).

Patent Document 1: Japanese Patent No. 2510746

Patent Document 2: Japanese Patent Publication No. 6-15394

DISCLOSURE OF THE INVENTION

Problems to be Solved by the Invention

In the destination floor indication device described in Patent Document 1, destination floors are indicated by the lighting of a car call button itself and, therefore, for example, when the number of service floors is large, a large number of car call buttons are arranged, posing the problem that the car call buttons are difficult to see, and posing the problem that persons with weak eyesight cannot easily see floor designations of the car call buttons because of the small size of the floor designations.

In the destination floor indication device described in Patent Document 2, when destination floors are scroll displayed, it is necessary to ascertain whether a desired destination floor has already been registered, the relevant elevator user waits until the indication of the indicator reaches the display position of the destination floor in question, poising the problem that it takes time to make sure of this.

The present invention has been made to solve problems as described above, and the object of the invention is to provide a destination floor indication device that enables elevator users to get to know destination floors that have already been registered easily and in a short time.

Means for Solving the Problems

A destination floor indication device of an elevator of the present invention is a destination floor indication device that is installed in a hall or car of the elevator and indicates destination floors to users, which comprises an indication part that indicates registered destination floors to users; and an indication control part that controls indication contents of the indication part and functions in such a manner that when the number of indications of registered destination floors exceeds a prescribed specified value, the size of indications of destination floors is made smaller than when the specified value is not exceeded, whereby all registered destination floors are caused to be indicated in the indication part.

Effect of the Invention

According to the present invention, elevator users can get to know destination floors that have already been registered easily and in a short time.

DESCRIPTION OF SYMBOLS

1 destination floor indication device,
2 controller,
3 communication path,
4 indication part,
5 indication control part,
6 indication information storage part,
7 communication part,
8 memory,
9 microcomputer,
10 indications judgment part,
11 indication magnification setting part,
12 indication position setting part,
13 indication control circuit part,
14 indication information inputting part

BEST MODE FOR CARRYING OUT THE INVENTION

The present invention will be described in more detail with reference to the accompanying drawings. Incidentally, in each of the drawings, like numerals refer to like or similar parts and overlaps of description of these parts are appropriately simplified or omitted.

Embodiment 1

Figure 1:
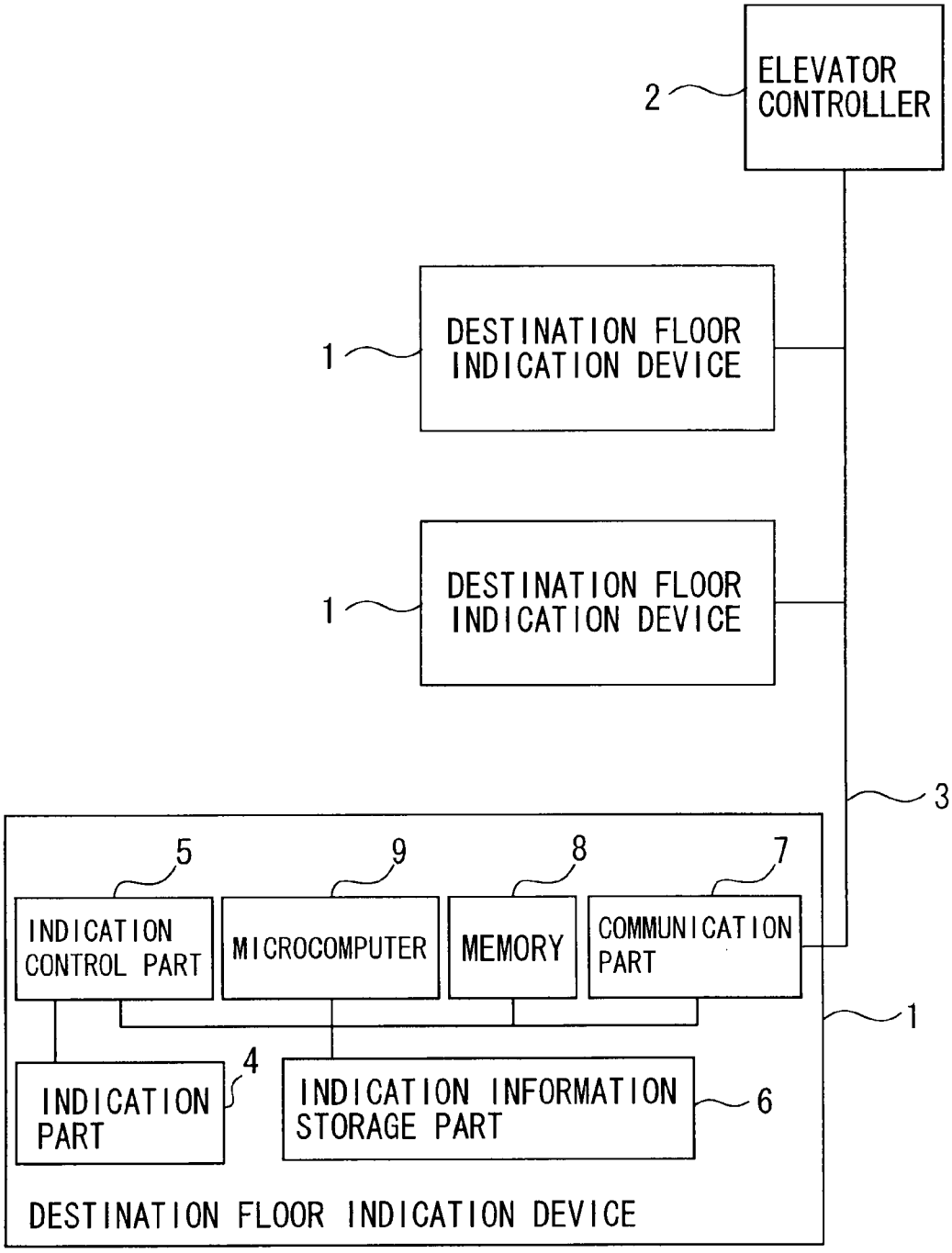
FIG. 1 is a block diagram showing a destination floor indication device of an elevator in Embodiment 1 of the present invention.
Figure 2:
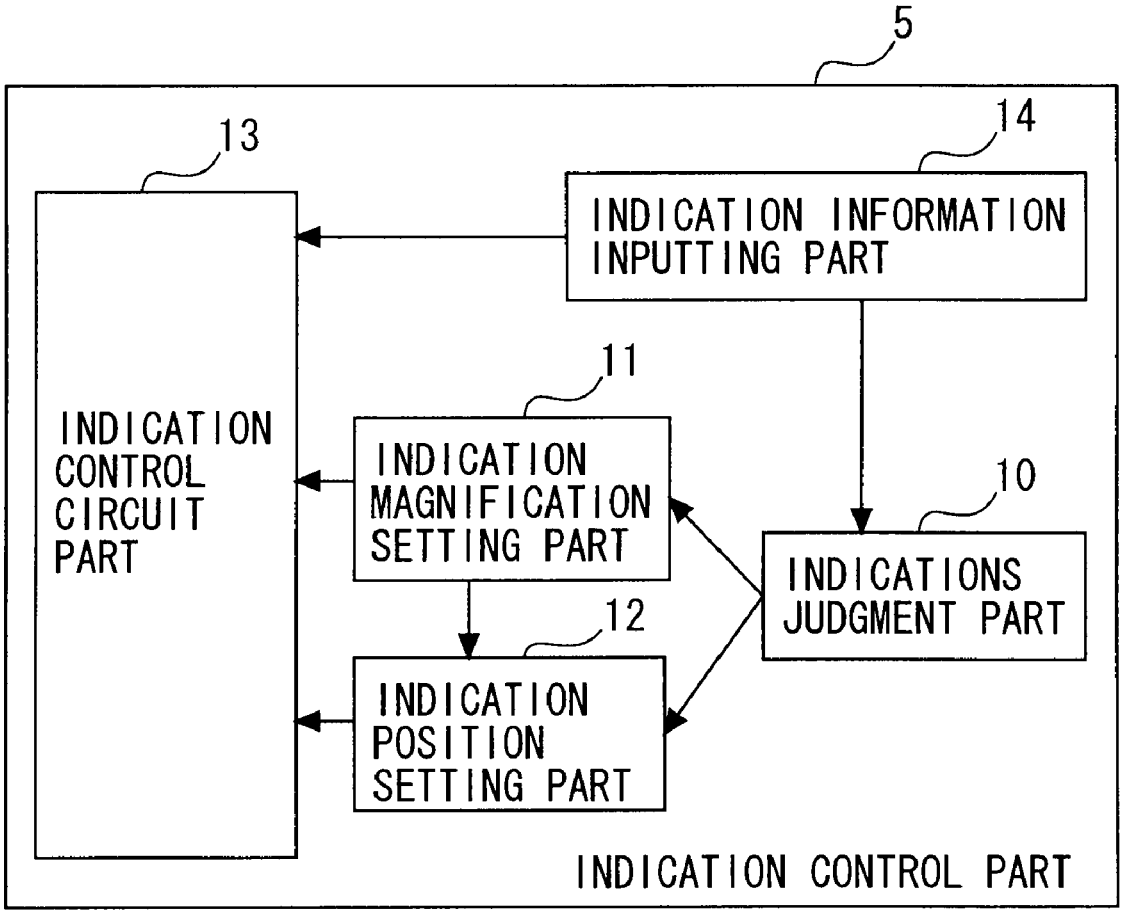
FIG. 2 is a block diagram showing an essential part of the destination floor indication device of an elevator in Embodiment 1 of the present invention.
Figure 3:
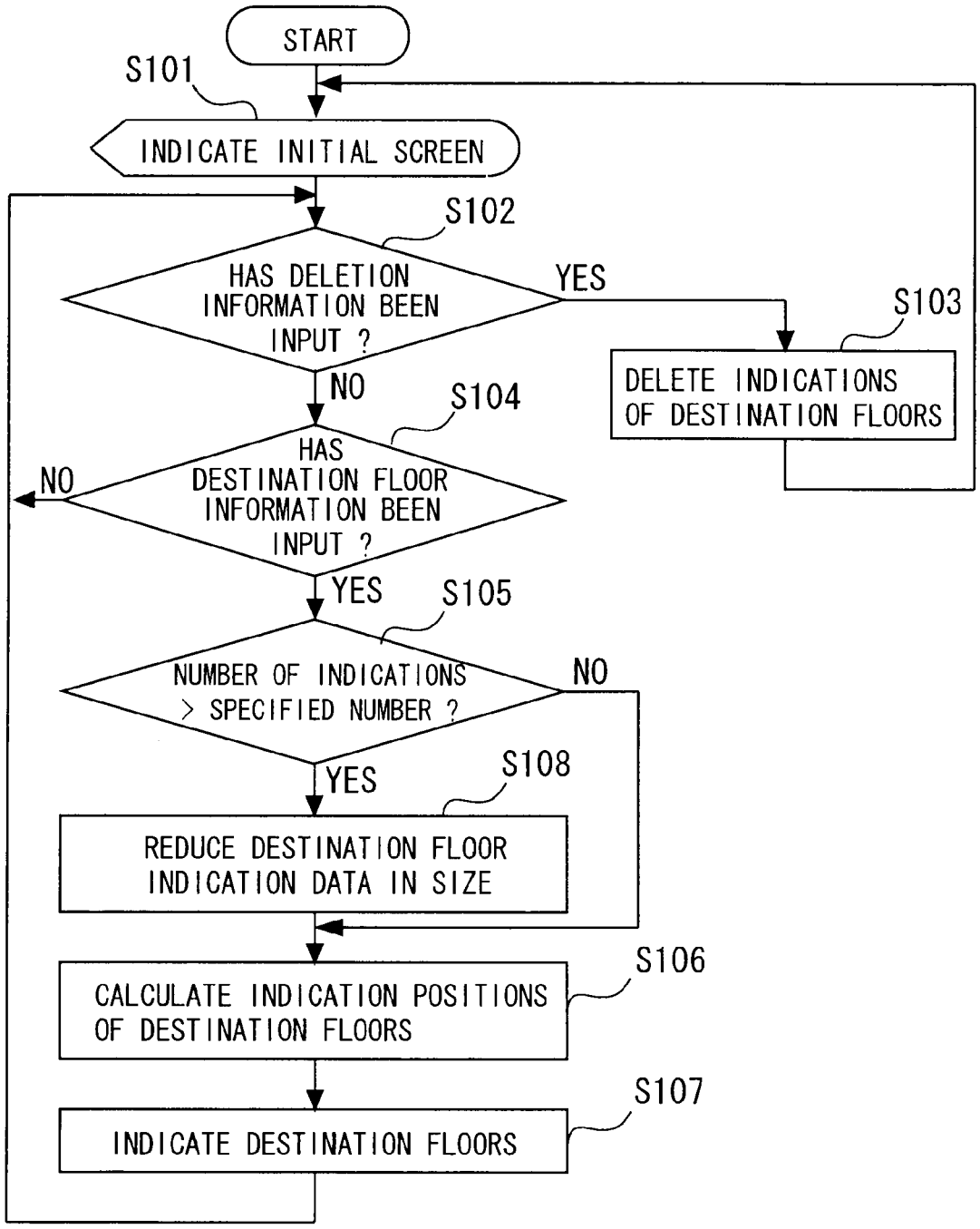
FIG. 3 is a flowchart showing the operation of the destination floor indication device of an elevator in Embodiment 1 of the present invention.
Figure 4:
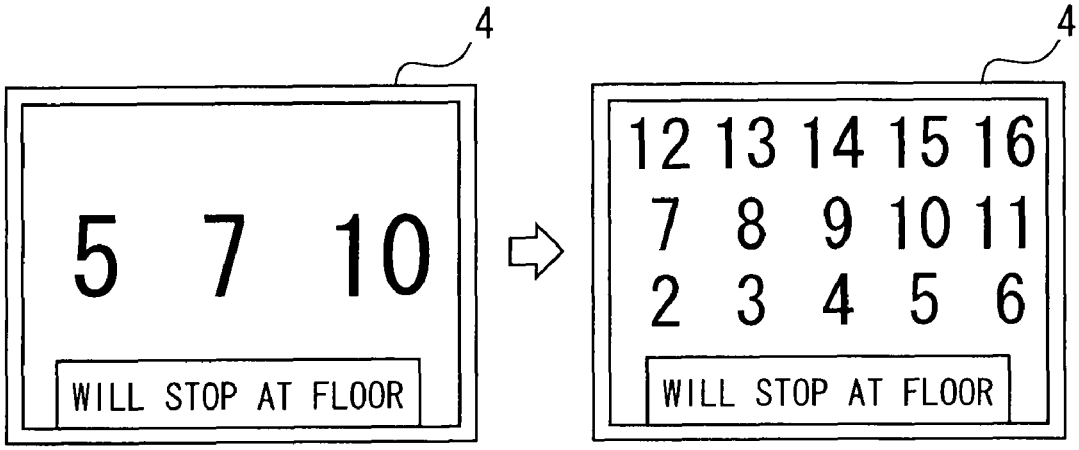
FIG. 4 is a diagram showing the indication contents of the destination floor indication device of an elevator in Embodiment 1 of the present invention.

FIG. 1 is a block diagram showing a destination floor indication device of an elevator in Embodiment 1 of the present invention. FIG. 2 is a block diagram showing an essential part of the destination floor indication device of an elevator in Embodiment 1 of the present invention. FIG. 3 is a flowchart showing the operation of the destination floor indication device of an elevator in Embodiment 1 of the present invention. FIG. 4 is a diagram showing the indication contents of the destination floor indication device of an elevator in Embodiment 1 of the present invention.

In FIGS. 1 and 2, at least part of destination floor indication devices 1 are provided in a hall or car of an elevator and indicate destination floors of the elevator to users in the hall or car. Each of the destination floor indication devices 1 is connected by a communication path 3 to a controller 2 that manages the whole control of the elevator, and receives necessary information, for example, information on destination floors that have been registered (destination floor information) from the controller 2. Incidentally, a destination floor registration device through use of which users register destination floors (not shown) is provided in a hall or car. And destination floor information registered through use of this destination floor registration device is first sent to the controller 2. After receiving this destination floor information, the controller 2 performs necessary control, such as causing an elevator car to travel to registered destination floors, and sends destination floor information to each of the destination floor indication devices 1 connected by the communication path 3.

Each of the destination floor indication devices 1 is provided with, for example, an indication part 4, an indication control part 5 that controls the indication contents of the indication part 4, an indication information storage part 6 in which indication information to be indicated in the indication part 4, such as letters and graphics, is stored, a communication part 7 that controls the communication path 3, a memory 8, and a microcomputer 9. The above-described indication part 4 is intended for indicating registered destination floors to users and is arranged in a place easily seen by users from the hall or from inside the car. It is necessary only that this indication part 4 has a function of capability of changing the contents to be indicated, and the indication part 4 is formed of an indicator of, for example, a liquid crystal display, a plasma display, an LED and a cathode-ray tube.

The above-described memory 8 is provided with a work memory and a program storage memory in which prescribed programs are stored, and the microcomputer 9 executes programs stored in the above-described program storage memory while using the work memory. Concretely, the microcomputer 9 first takes out of the communication part 7 destination floor information input from the controller 2. And the microcomputer 9 takes out of the indication information storage part 6 indication information corresponding to the destination floor information taken out of the communication part 7, and sends this indication information to the indication control part 5, thereby causing the indication part 4 to indicate destination floors.

Incidentally, the work memory, the program storage memory, and the indication information storage part 6 may be formed of any storage device and storage element, such as a hard disk drive, a non-volatile memory, and a dynamic random access memory, and the work memory, the program storage memory, and the indication information storage part 6 may also be configured in such a manner that some of these are used in the same storage device or storage element. All or part of the indication control part 5, the indication information storage part 6, the communication part 7, and the memory 8 may be incorporated in the microcomputer 9.

The above-described indication control part 5 functions in such a manner that when the number of indications of registered destination floors exceeds a prescribed specified value, the size of indications of destination floors is made smaller than when the specified value is not exceeded, whereby all registered destination floors are caused to be indicated in the indication part 4. The indication control part 5, which has such a function, is provided with, for example, an indications judgment part 10, an indication magnification setting part 11, an indication position setting part 12, an indication control circuit part 13, and an indication information inputting part 14. The above-described indications judgment part 10 judges the number of indications of registered destination floors, i.e., destination floors that the indication part 4 is caused to indicate. For example, the indications judgment part 10 makes a judgment as to whether the number of indications that the indication part 4 is caused to indicate exceeds a prescribed specified number.

On the basis of judgment results of the indications judgment part 10 the above-described indication magnification setting part 11 sets the indication magnification of destination floors that the indication part 4 is caused to indicate. For example, when it is judged by the indications judgment part 10 that the number of indications exceeds the above-described specified number, the indication magnification setting part 11 lowers the indication magnification, whereby the indication of destination floors in the indication part 4 is caused to decrease in size. That is, the indication magnification setting part 11 causes the indication part 4 to indicate destination floors in small letters and graphics. Incidentally, as a matter of fact, the above-described indication magnification is set on the basis of a prescribed reference value. On the basis of the number of indications of destination floors that the indication part 4 is caused to indicate and the indication magnification set by the indication magnification setting part 11, the above-described indication position setting part 12 sets the indication positions of destination floors so that users easily see the indications. And on the basis of the indication magnification and indication positions that are set above, the indication control circuit part 13 causes the indication part 4 to simultaneously indicate all registered destination floors.

Next, on the basis of FIG. 3, a description will be given of the operation of the destination floor indication device 1 of an elevator having the above-described configuration. When the destination floor indication device 1 starts operation, a necessary initial screen, such as a background screen and a message, is indicated in the indication part 4 (Step S101). Next, a judgment is made as to whether deletion information has been input from the controller 2 via the communication path 3 to the effect that destination floors are to be deleted (Step S102). When the deletion information has been input, all destination floors are deleted (Step S103) and the indication part 4 is caused to indicate an initial screen.

When in Step S102 deletion information has not been input, next, a judgment is made as to whether there is destination floor information (Step S104). And when destination floor information has not been input from the controller 2, the processing returns to the procedure for making a judgment again as to whether there is deletion information. On the other hand, when the communication part 7 has received destination floor information, on the basis of the received destination floor information, an action for causing the indication part 4 to indicate a newly registered destination floor is performed.

Concretely, first, a judgment is made as to whether the number of indications of registered destination floors, i.e., destination floors that the indication part 4 is caused to indicate, exceeds a specified number (Step S105). The above-described number of indications of destination floors that is compared to a specified number means the number of indications used when the indication part 4 is caused to indicate all of the newly registered destination floor and already registered destination floor. And when it is judged in Step S105 that the number of indications of destination floors is not more than a specified number, to ensure that all destination floors including the newly registered destination floor are simultaneously indicated in the indication part 4, the indication positions are calculated (Step S106) and destination floors are indicated in the calculated indication positions (Step S107). Incidentally, in such a case the number of indications of destination floors does not exceed the specified number, and hence the destination floors are indicated in the indication part 4 in a size of an initially set value. That is, in Step S106, the indication position setting part 12 calculates the indication positions on condition that all destination floors are indicated in a size of an initially set value.

On the other hand, when it is judged in Step S105 that the number of indications of destination floors exceeds the specified number, in order to cause the indication part 4 to indicate destination floors in a size smaller than the size of the above-described initially set value, destination floor indication data is caused to decrease in size (Step S109) and thereafter the calculation of indication positions is performed (Step SS106). That is, in Step S106, the indication position setting part 12 calculates the indication positions on condition that all destination floors are indicated in a size of a specified value smaller than the initially set value. And after the completion of the calculation of the indication positions, on the basis of a newly set indication magnification and newly calculated indication positions, all registered destination floors are simultaneously indicated in the indication part 4 (Step S108).

Incidentally, the flowchart shown in FIG. 3 shows the operation performed when registered destination floors are indicated in two-stage sizes in the indication part 4. That is, shown is the operation which is such that the destination floors are indicated in a large size when the number of registered destination floors is small and the destination floors are indicated in a small size when the number of registered destination floors increases. However, in an elevator that has many floors at which the elevator stops, for example, in an elevator provided in a high-rise building, in order to maintain the indications of the indication part 4 in a condition as large as possible, the size of destination floors indicated in the indication part 4 may be divided in three stages or more on the basis of the number of indications of registered destination floors. For example, when the size of indications of registered destination floors is to be reduced in four stages as the number of registered destination floors increases, the number of indications and indication magnifications corresponding to each stage are set beforehand, and optimum indication positions are calculated on the basis of the judged number of indications and set indication magnifications.

Next, on the basis of FIG. 4, a description will be given of concrete indication contents of the destination floor indication device 1. FIG. 4 shows indication contents of a case where the size of indications of destination floors indicated in the indication part 4 is set in two stages in the destination floor indication device 1 provided in an elevator that stops at each floor from the first floor to the 16th floor. Incidentally, in the destination floor indication device 1 shown in FIG. 4, the message "WILL STOP AT FLOOR" is constantly indicated in a stationary condition in the lower portion of the screen of the indication part 4. However, this message may be written in other words and may not be indicated in a stationary condition. The above-described specified number in this destination floor indication device 1 is 3.

In the elevator of the above configuration, when a user registers first the fifth floor as a destination floor, "5" is indicated in the middle portion of the indication part 4 provided in the hall and the like. When the 10th floor is then registered, "5□10" (□ denotes a space) is indicated in the middle portion of the indication part 4. When the 7th floor is further registered, "5□7□10" is indicated in the middle portion of the indication part 4. Because so far the number of indications is not more than the specified number, destination floors are indicated in a size of an initially set value in the indication part 4 and hence indicated in a size that is large to some extent.

Next, when a destination floor is registered as the fourth-registered destination floor that exceeds the specified number, the indications of destination floors in the indication part 4 become small. The right-hand part of FIG. 4 shows a case where each floor from the second floor to the 16th floor is registered as destination floors, and shows the condition in which the indications of the destination floors in the indication part 4 become smaller than the initially set value and indication positions are appropriately calculated so that all destination floors can be indicated. Incidentally, although in FIG. 4 a case where the indications of the destination floors are lined up in a vertically and laterally center-aligned manner is shown as an example, any indication method can be adopted.

According to Embodiment 1 of the present invention, elevator users can get to know already registered destination floors easily and in a short time before the elevator users resister their own destination floors. That is, when the number of indications of registered destination floors is small, the destination floors are indicated in a large size in the indication part 4 and, therefore, users can easily recognize the destination floors. On the other hand, when the number of indications of registered destination floors increases, the destination floors are indicated in the indication part 4 in a size reduced to a prescribed magnification so that all of the registered destination floors can be indicated and hence, unlike a conventional practice, it does not take a long time for users to ascertain whether their own destination floors have been registered and it becomes possible to perform this ascertainment swiftly.

Embodiment 2

Figure 5:
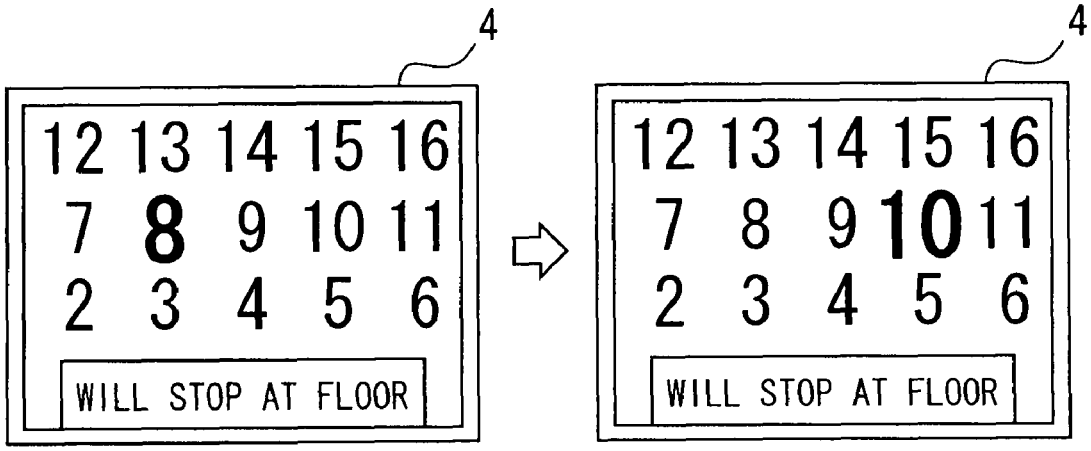
FIG. 5 is a diagram showing the indication contents of a destination floor indication device of an elevator in Embodiment 2 of the present invention.

FIG. 5 is a diagram showing the indication contents of a destination floor indication device of an elevator in Embodiment 2 of the present invention. Incidentally, FIG. 5 corresponds to FIG. 4, and shows the indications of the indication part 4 in a case where destination floors whose number exceeds a specified number have been registered. In such a case, in order to cause the indication part 4 to indicate all registered destination floors, in the same manner as in Embodiment 1, the indication control part 5 causes the indications of the indication part 4 to be reduced in size compared to the size in an initially set value.

The indication control part 5 causes the indication part 4 to indicate part of registered destination floors in a size larger than the size in other parts. That is, a part of registered indication floors is indicated in an enlarged size. And the indication control part 5 sequentially changes part of destination floors that are indicated in an enlarged size, whereby it is ensured that all destination floors are indicated in the indication part 4 in an enlarged size within a prescribed time. Incidentally, when enlarged indications of all destination floors have taken a round and all destination floors are indicated in an enlarged size in the indication part 4, the above-described control is performed again and the enlarged indications are repeated.

Incidentally, FIG. 5 shows a case where the numerals indicative of destination floors are indicated in an enlarged size in increasing order. Any order and method of indication in an enlarged size can be adopted. For example, the indication region of the indication part 4 may be divided in such a manner that each of the divided regions is sequentially indicated in an enlarged size. The above-described control may be performed in the indication control circuit part 13 of the indication control part 5 and new means for the above-described control may also be separately provided.

According to Embodiment 2 of the present invention, even when the number of registered destination floors increases and the indications of the indication part 4 are reduced in size, part of indications are sequentially indicated in an enlarged size and, therefore, for example, even persons with weak eyesight can ascertain the indications easily and in a short time. In other respects, Embodiment 2 has the same constitutional features and effects as Embodiment 1.

INDUSTRIAL APPLICABILITY

As described above, according to the destination floor indication device of an elevator related to the present invention, elevator users can get to know already registered destination floors easily and in a short time, and it becomes possible to improve the convenience expected when elevator users register destination floors and further to improve the elevator service as a whole.

The invention claimed is:

1. A destination floor indication device of an elevator that is installed in a hall or car of the elevator and indicates destination floors to users, comprising:

an indication part that indicates registered destination floors to users; and an indication control part that controls indication contents of the indication part and functions in such a manner that when the number of indications of registered destination floors exceeds a prescribed specified value, the size of indications of destination floors is made smaller than when the specified value is not exceeded, whereby all registered destination floors are caused to be indicated in the indication part.

2. The destination floor indication device of an elevator according to claim 1, wherein the indication control part functions in such a manner that when the number of indications of registered destination floors exceeds a prescribed specified value, the size of part of registered destination floors is made larger than the size of other parts, whereby all registered destination floors are caused to be indicated in the indication part.

3. The destination floor indication device of an elevator according to claim 2, wherein the indication control part functions in such a manner that when the number of indications of registered destination floors exceeds a prescribed specified value, part of destination floors that are indicated in an enlarged size is sequentially changed, whereby all registered destination floors are caused to be indicated in the indication part in the enlarged size within a specified time.

4. The destination floor indication device of an elevator according to claim 1, wherein the indication control part comprises:

an indications judgment part that judges the number of indications of registered destination floors;

an indication magnification setting part that sets the indication magnification of destination floors on the basis of judgment results of the indications judgment part;

an indication position setting part that sets the indication position of destination floors on the basis of the number of indications judged by the indications judgment part and the indication magnification set by the indication magnification setting part; and an indication control circuit part that causes all registered destination floors to be indicated in the indication part on the basis of the indication magnification set by the indication magnification setting part and the indication position set by the indication position setting part.

5. The destination floor indication device of an elevator according to claim 2, wherein the indication control part comprises:

an indications judgment part that judges the number of indications of registered destination floors;

an indication magnification setting part that sets the indication magnification of destination floors on the basis of judgment results of the indications judgment part;

an indication position setting part that sets the indication position of destination floors on the basis of the number of indications judged by the indications judgment part and the indication magnification set by the indication magnification setting part; and an indication control circuit part that causes all registered destination floors to be indicated in the indication part on the basis of the indication magnification set by the indication magnification setting part and the indication position set by the indication position setting part.

6. The destination floor indication device of an elevator according to claim 3, wherein the indication control part comprises:

an indications judgment part that judges the number of indications of registered destination floors;

an indication magnification setting part that sets the indication magnification of destination floors on the basis of judgment results of the indications judgment part;

an indication position setting part that sets the indication position of destination floors on the basis of the number of indications judged by the indications judgment part and the indication magnification set by the indication magnification setting part; and an indication control circuit part that causes all registered destination floors to be indicated in the indication part on the basis of the indication magnification set by the indication magnification setting part and the indication position set by the indication position setting part.

* * * * *